United States Patent [19]

Wechsler

[11] 4,417,740

[45] Nov. 29, 1983

[54] VEHICLE FOR COASTING DOWN IN A CHANNELSHAPED ROLLER SLIDE

[75] Inventor: Hans G. Wechsler, Schwaz, Austria

[73] Assignees: Horst Schwamm, Sistrans; Friedbert Pessei, Grinzens, both of Austria

[21] Appl. No.: 258,275

[22] Filed: Apr. 28, 1981

[30] Foreign Application Priority Data

May 5, 1980 [AT] Austria ..... 2371/80

[51] Int. Cl.[3] ..... A63G 21/02

[52] U.S. Cl. ..... 280/87.01; 104/69; 280/79.1 R; 280/113

[58] Field of Search ..... 280/87.01, 113, 125, 280/117, 111, 79.1 R; 104/69, 63, 53, 118, 119

[56] References Cited

U.S. PATENT DOCUMENTS

| | | | |
|---|---|---|---|
| 2,539,360 | 1/1951 | Bartlett | 104/63 |
| 3,006,286 | 10/1961 | Bacon et al. | 104/63 |
| 3,908,556 | 9/1975 | Stühmer | 104/69 |
| 4,221,170 | 9/1980 | Koudelka | 104/63 |

*Primary Examiner*—David M. Mitchell

*Attorney, Agent, or Firm*—Wenderoth, Lind & Ponack

[57] ABSTRACT

For coasting down in a non-rail, channel-shaped roller slide having straight and curved sections, a vehicle comprises a chassis with unsteered wheels, each front wheel being mounted on a supporting member. The axle of each front wheel is arranged with caster behind a pivoting support of the supporting member extending normally thereto. The pivoting movement of the front wheel is limited by coacting stops arranged on the chassis and on the supporting member.

8 Claims, 5 Drawing Figures

VEHICLE FOR COASTING DOWN IN A CHANNELSHAPED ROLLER SLIDE

BACKGROUND OF THE INVENTION

1. FIELD OF THE INVENTION

The present invention relates to a vehicle for use in coasting down a non-rail channel-shaped roller slide, the curves of the roller slide being banked on their outer sides, said vehicle comprising a chassis with unsteered wheels.

2. DESCRIPTION OF THE PRIOR ART

Slides of channel-shaped cross-section built on a mountain slope have generally become known as summer toboggan slides. In general, passengers coast down such slides in sleds gliding on skids. A sled of this type has, for example, been described in the Austrian Patent No. 331,160. This sled, which normally glides on skids, is additionally provided with rollers adapted to be lowered by means of a lever. Such rollers serve as an accelerating means for the sled. Such sleds have inefficient dynamic gliding characteristics, and they have, further, the disadvantage that the slide is exposed to relatively great wear.

it has further been proposed to coast down over slides on mountain slopes in vehicles which have a chassis provided with wheels. The wheels are mounted on rigid axles, and the vehicle can be braked by means of skids adapted to be lowered for braking action. Excessive wear of the track is eliminated by means of such vehicles, but their dynamic gliding characteristics still remain unsatisfactory. It also has been proven that such vehicles easily overturn, when gliding into curves as well as when gliding out thereof.

SUMMARY OF THE INVENTION

It is, therefore, the object of the invention to provide an improved vehicle of the above-described type, whereby turning-over of the vehicle in the slide, particularly when gliding out of a curve, is largely eliminated. When gliding through curves, the vehicle should continuously mount into an inclined position substantially free of lateral forces, and even in the case of driving-errors, e.g. incorrect position of the driver or sudden braking, the vehicle should smoothly and safely glide through the curve.

According to the invention, this is achieved by mounting each front wheel on a supporting member, the axle of the front wheel being arranged with caster behind a pivot axis of the supporting member extending normally thereto, and by limiting the pivoting movement of the front wheel by coacting stops arranged on the chassis and on the supporting member.

Hence, because of centrifugal moments the pivotable wheels of the vehicle are moved into slightly tilted positions about the normal axis carrying the unsteered wheels, when the direction of the slide changes. The vehicle continuously mounts the outer side of the banked slide, when entering into the curve, and subsequently descends, when leaving by the curve.

When the front wheels are provided with a camber, the camber angle preferably corresponding to the angle between a horizontal line and the tangent to the slide at the surface of the wheels, it is, possible to spare the wheels as far as possible, as they are exposed to a symmetric load and also the cross-sectional shape of the chassis can be adapted generally to the shape of the slide, thereby maintaining the center of gravity of the vehicle very low.

The optimal extent of the caster provided according to the invention has been determined by tests. Is has been found that good results will be obtained if the ratio of longitudinal distance between the front and rear wheels to the distance of the caster of the front wheels is about 9:1. In this case, the desired effect is obtained to a sufficient extent, and lurching motions, which may be observed in case of excessive caster, do not occur.

The main purpose of limiting the movement of the wheels around their pivot is to eliminate extreme changes of direction because of driving errors. Hence, a compromise solution should be aimed at, such solution offering sufficient safety and, moreover, eliminating recurrent track corrections by means of the stops. It has proved advantageous to make the front wheels pivotable within an angle of between $\pm 3°$ and $\pm 9°$, particularly of $\pm 6°$.

BRIEF DESCRIPTION OF THE DRAWINGS

In the following an embodiment of the invention will be described in greater detail with reference to the accompanying drawings, without being limited thereto, and wherein.

DESCRIPTION OF A PREFERRED EMBODIMENT

Figure 1:
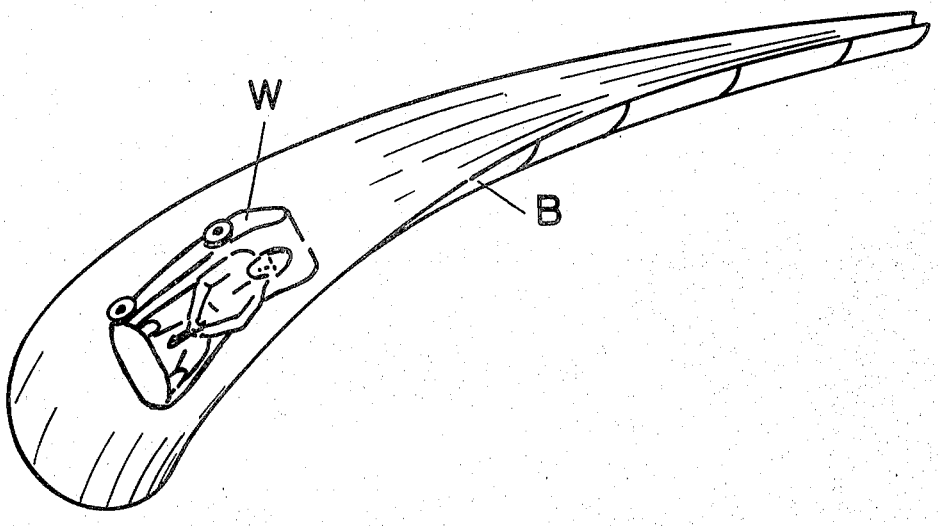
FIG. 1 is a perspective view of the entrance into a left turn of a track by a vehicle according to the invention.

FIG. 1 shows the entrance into a left turn of a track B in which a vehicle W rolling on wheels moves downhill. The top view of the curve entrance is preferably clothoid-shaped, whereas the cross-section of the track B has on the outer side of the curve substantially the profile of a quarter of an ellipse with continuously changing parameters. The vehicle W gliding into the curve shall mount harmonically on the outer side of the cuve and pass therethrough without lateral forces.

Figure 2:
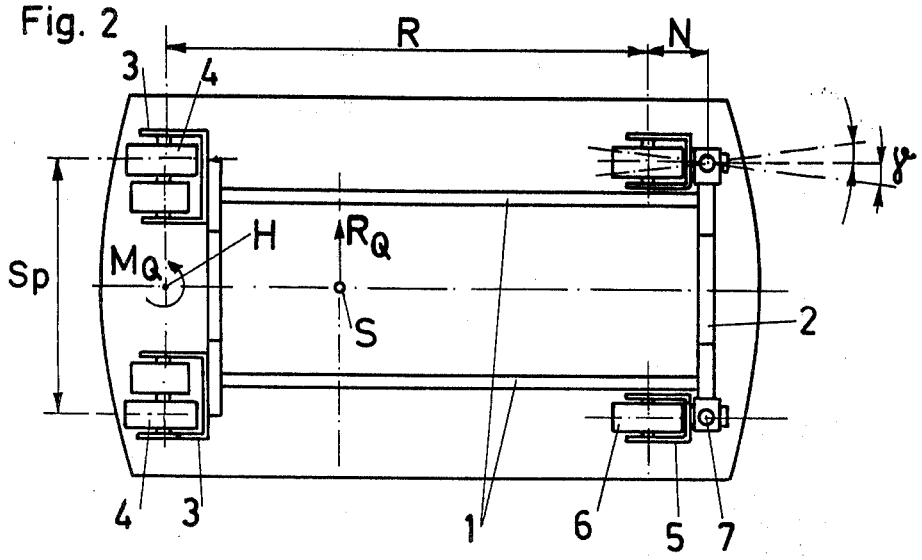
FIG. 2 is a top view of the chassis of the vehicle.
Figure 3:
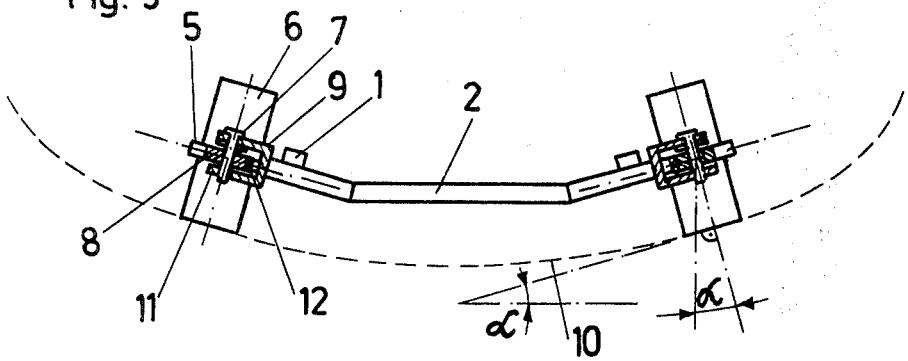
FIG. 3 is a front view of the chassis, parts thereof being shown in section.
Figure 5:
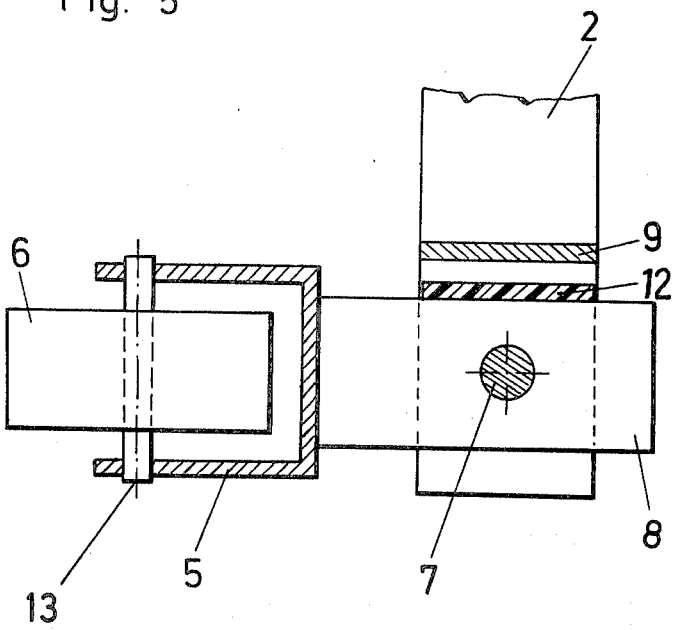
FIG. 5 is an enlarged sectional view of the bearing region of a front wheel normal to a pivoting axle.

FIG. 2 shows the top view of the chassis of the vehicle. The chassis comprises two longitudinal supporting members 1, cross members 2 being arranged on their ends. Two forks 3 are rigidly connected to the rear cross member, such forks retaining the axles of the rear wheels 4. As FIGS. 3 and 5 illustrated in FIG. 3, U-shaped bearing members 11 are fixed to the ends of the front cross member 2, such bearing members being penetrated by steering pines 7. Such steering pins 7 are mounted by means of combined radial-axial bearing steering knuckles including mounting portions 8. Fork portions 5 holding axles 13 of front wheels 6 are fixed to steering mounting portions 8. Each steering knuckle is pivotally mounted about the axis of the respective pin 7 within a limited range, the possible pivot angle (see FIG. 2) being limited in that one side wall of the steering knuckle is provided with a rubber plate 12 forming a stop which abuts with the connection web 9 of the respective U-shaped bearing member 11 forming a stop coacting with plate 12. Hence, each front wheel 6 has a caster N defined by the longitudinal distance between the axle 13 and the steering pin 7. Further, the opposite ends of the cross members 2 are upwardly angled so that the steering pins 7 and the wheels 4 and 6 are provided with reverse camber. The camber angle (see FIG. 3) substantially corresponds to the angle between the horizontal line and the tangent to the track in the main bearing area of the wheels. As a result, the center of gravity of the vehicle is positioned as low as possible and, further, the wear of the tires is kept low and a good braking effect is obtained.

Figure 4:
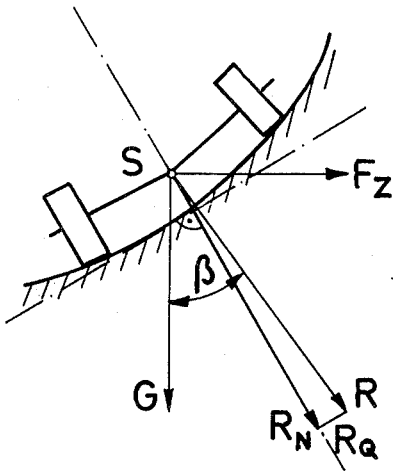
FIG. 4 is a diagram showing the forces existing in a curve and acting upon the vehicle.

If a lateral force $R_Q$ acts upon the center of gravity S because of a change in the direction of the ride, such lateral force effects pivoting momentum $M_Q$ about a vertical axis H by means of the rear axle. Such pivoting momentum tends to create an inclined position of the front wheels 6 and a pivoting movement of wheels 6 about the steering pins 7. The convergency angle $\gamma$ is, as already mentioned, limited by stops 9, 12. Hence, the vehicle mounts continuously on the outer side of the curve, when gliding into the curve, and the danger of turning over is eliminated even in case of driving errors. The forces acting upon the vehicle, when gliding through the curve, are illustrated in FIG. 4. The weight G and the centrifugal force $F_Z$ dependent on the speed act upon the center of gravity S. If no lateral forces become effective, when the vehicle glides down, the resultant force R extends normally to the tangent to the track. If, however, the inclined position of the vehicle deviates from the ideal position because of a driving error a lateral force $R_Q$ becomes effective in addition to the normal force $R_N$.

The driving characteristics have proved particularly advantageous, when the relationship between the longitudinal distance R wheels 4, 6 and caster N is about 9:1. The wheel distance R can, for example, be about 800 mm and the wheel gauge $S_P$ about 400 mm. The pivoting angle should be limited within a range of $\pm 6°$.

What is claimed is:

1. A vehicle for use in coasting down a non-rail roller slide of the type having a channel-shaped curved transverse cross-sectional configuration and having straight and curved length sections, with such curved length sections having banked outer sides, said vehicle comprising:

a vehicle chassis including at least one longitudinal member having rigidly fixed to front and rear ends thereof respective front and rear transverse cross members, each said cross member having a transverse configuration curved to conform generally to the transverse configuration of the slide on which said vehicle is to be used;

rear wheels mounted for rotation by respective rear axles mounted in fixed alignment with respect to said rear cross member;

a pair of supporting members, each said supporting member having a rearwardly extending generally fork-shaped portion supporting an axle of a respective front wheel and a forwardly extending mounting portion pivotally mounted to a respective opposite end of said front cross member for rotation about a respective pin extending generally orthogonal to said axle of said respective front wheel, such that said front wheels are mounted with caster with respect to said front cross member, and such that said front wheels and respective said supporting members are pivotable about said respective pins with respect to said front cross member;

stop means on said chassis and on each of said supporting members for limiting the extent of pivotal movement of each of said front wheels with respect to said front cross member; and said rear wheels and said front wheels being mounted with reverse camber, the camber angle of each said wheel being equal to the angle between the horizontal and a tangent to the point of contact of said wheel to the slide on which said vehicle is to be used.

2. A vehicle as claimed in claim 1, further comprising a pair of generally fork-shaped rear wheel mounting members, each said rear wheel mounting member being rigidly fixed to and extending rearwardly from a respective opposite end of said rear cross member, and each said rear wheel mounting member supporting a respective said rear axle and rear wheel.

3. A vehicle as claimed in claim 1, further comprising a pair of generally U-shaped bearing members, each said bearing member including a pair of leg portions supporting a respective said pin and a web portion connecting said leg portions and rigidly fixed to a said respective opposite end of said front cross member.

4. A vehicle as claimed in claim 3, wherein said stop means comprise plates mounted on said mounting portions of said supporting members and said web portions of said bearing members.

5. A vehicle as claimed in claim 4, wherein said plates are formed of a rubber material.

6. A vehicle as claimed in claim 1, wherein the ratio of the longitudinal distance between said front axles and said rear axles to the longitudinal distance between said pins and said front axles is approximately 9:1.

7. A vehicle as claimed in claim 1, wherein said stop means limit the pivoting movement of said front wheels to an angle of between $\pm 3°$ and $\pm 9°$.

8. A vehicle as claimed in claim 7, wherein said angle is approximately $\pm 6°$.

* * * * *

UNITED STATES PATENT AND TRADEMARK OFFICE

CERTIFICATE OF CORRECTION

PATENT NO. : 4,417,740

DATED : November 29, 1983

INVENTOR(S) : Hans G. Wechsler

It is certified that error appears in the above—identified patent and that said Letters Patent is hereby corrected as shown below:

On the title page:

"[73] Assignees: Horst Schwamm, Sistrans; Friedbert Pessei, Grinzens, both of Austria"

SHOULD BE

--[73] Assignees: Horst Schwamm, Sistrans; Friedbert Pezzei, Grinzens, both of Austria--

Signed and Sealed this

*Fifteenth* Day of *May 1984*

[SEAL]

*Attest:*

GERALD J. MOSSINGHOFF

*Attesting Officer*

*Commissioner of Patents and Trademarks*